US011236978B2

(12) United States Patent
Bindhammer

(10) Patent No.: US 11,236,978 B2
(45) Date of Patent: Feb. 1, 2022

(54) DISTANCE COMBAT MEANS FOR NON-LETHAL EXPOSURE OF THE HUMAN OR ANIMAL BODY TO IRRITANT

(71) Applicant: Markus Bindhammer, Friedberg (DE)

(72) Inventor: Markus Bindhammer, Friedberg (DE)

( * ) Notice: Subject to any disclaimer, the term of this patent is extended or adjusted under 35 U.S.C. 154(b) by 277 days.

(21) Appl. No.: 16/332,111

(22) PCT Filed: May 12, 2017

(86) PCT No.: PCT/EP2017/025125

§ 371 (c)(1),
(2) Date: Mar. 11, 2019

(87) PCT Pub. No.: WO2018/046132

PCT Pub. Date: Mar. 15, 2018

(65) Prior Publication Data

US 2019/0212113 A1 Jul. 11, 2019

(30) Foreign Application Priority Data

Sep. 12, 2016 (EP) ..... 16020328

(51) Int. Cl.
*F42B 12/50* (2006.01)
*F41H 9/10* (2006.01)
*F42B 5/145* (2006.01)

(52) U.S. Cl.
CPC ..... *F42B 12/50* (2013.01); *F41H 9/10* (2013.01); *F42B 5/145* (2013.01)

(58) Field of Classification Search
CPC ..... F42B 12/50; F42B 12/00; F42B 12/36; F42B 12/46; F42B 5/135; F41H 9/10
USPC ..... 102/370
See application file for complete search history.

(56) References Cited

U.S. PATENT DOCUMENTS 1,517,554 A * 12/1924 Fulcher ..... F42B 12/54 102/370
2,136,024 A * 11/1938 Schneider ..... B05B 7/0853 427/426
5,088,624 A * 2/1992 Hackett ..... B65D 83/68 222/78
7,121,434 B1 * 10/2006 Caruso ..... B65D 83/206 222/402.13

(Continued)

FOREIGN PATENT DOCUMENTS

DE 8909166 U1 11/1989
DE 202006004268 U1 5/2006

(Continued)

OTHER PUBLICATIONS

International Search Report, EPO, The Netherlands, dated Jul. 20, 2017.

(Continued)

*Primary Examiner* — Joshua E Freeman
(74) *Attorney, Agent, or Firm* — Bacon & Thomas, PLLC

(57) ABSTRACT

A distance combat means for non-lethal exposure of the human or animal body to an irritant is provided. The distance combat means comprises a housing (2,4) containing at least an irritant (5), a propellant (3), and moreover at least a medical adhesive (7), namely a cyanoacrylate preparation, polyvinylpyrrolidone or cellulose nitrate. The irritant may be 2-chlorobenzylidene malonic acid dinitrile (CS), ω-chloroacetophenone (CN) or capsaicin (CPS).

20 Claims, 2 Drawing Sheets

(56) References Cited

U.S. PATENT DOCUMENTS

| | | | | |
|---|---|---|---|---|
| 7,690,311 | B1 * | 4/2010 | Cronemberger | F42B 12/46 102/502 |
| 8,186,275 | B1 | 5/2012 | Woodall et al. | |
| 9,022,255 | B1 * | 5/2015 | Calvert | F41H 9/10 222/79 |
| 2005/0066849 | A1 * | 3/2005 | Kapeles | F42B 12/50 102/517 |
| 2005/0188886 | A1 * | 9/2005 | Vasel | F42B 6/10 102/502 |
| 2010/0269762 | A1 * | 10/2010 | Johnson | F41H 9/10 119/712 |
| 2011/0067593 | A1 * | 3/2011 | Klein | F42B 12/745 102/439 |
| 2011/0214584 | A1 * | 9/2011 | Purvis | F42B 12/34 102/502 |
| 2014/0367407 | A1 * | 12/2014 | Breeden | F41H 9/10 222/1 |

FOREIGN PATENT DOCUMENTS

| | | | |
|---|---|---|---|
| FR | 2523718 | A1 | 9/1983 |
| JP | 2009002620 | A | 1/2009 |
| RU | 2111444 | C1 | 5/1998 |
| WO | 2006/055640 | A2 | 5/2006 |

OTHER PUBLICATIONS

IPRP of the Search Authority, The Netherlands, dated Jul. 20, 2017.

* cited by examiner

DISTANCE COMBAT MEANS FOR NON-LETHAL EXPOSURE OF THE HUMAN OR ANIMAL BODY TO IRRITANT

TECHNICAL FIELD

The invention relates to a distance combat means for non-lethal exposure of the human or animal body to irritant which comprises a housing containing at least an irritant, a propellant, and moreover at least a medical adhesive, namely a cyanoacrylate preparation, polyvinylpyrrolidone or cellulose nitrate.

BACKGROUND DISCUSSION

Conventional irritant gas distance combat means containing only irritant gas either exist as irritant gas spray cans or can be figured as irritant gas cartridges shootable by means of blank guns and/or gas pistols. Irritant gas cartridges do not comprise any projectile but a plug provided with a predetermined breaking point which plug is pressed into the cartridge case which in turn contains a charge of irritant.

In this connection, one tried already to develop irritant gas distance weapons with an additional benefit. Thus, the German utility model specification DE 8909166 U1 shows a tear gas cartridge with a case containing an irritant filling and a propelling charge, and having an igniter. The irritant filling consists here of an aqueous gel in which an irritant is dissolved with a coloring agent filling being provided in addition in a separate location from it in order to expose the target fired at not only to irritant gas but mark it also with coloring agent.

Further developments aim at improving adhesion of the irritant gas and/or irritant on the body to which it is exposed. Thus, in the international patent application WO 2006 055 640 A2, a pepper gel is proposed in composition as a component part of a self-defense spray which contains 0.1 to 1.5% capsaicinoid compounds and preferably at least 1.4% capsaicinoid. This composition allegedly adheres particularly well on surfaces, improves the reach of the spray and reduces the risk of spraying too much.

Moreover, irritant cartridges with several subsequent layers of propelling charges and irritants are known, see FR 2 523 718 A1.

Furthermore non-lethal projectiles are known which unlike irritant gas cartridges release their charge only on impact on the target. Such a projectile is described in U.S. Pat. No. 8,186,275 B1 wherein the charge can consist of a sticky foam mixed with irritants or color markings.

Japanese patent application JP 2009 002620 A discloses a cartridge case with a two-part plug, the upper chamber of which contains an adhesive agent which shall serve for marking an opponent and/or shall adhere to said opponent and the lower chamber of which shall contain an irritant such as, for example, capsaicin etc.

Finally, US patent specification U.S. Pat. No. 9,022,255 B1 discloses a distance weapon with a housing attached to a firearm, which accommodates three bottles of which one contains an adhesive, the second an activating agent for the adhesive and the third another ingredient. The further ingredient is a tranquilizer, a sopoforic, a poison, or an infectious agent or the like. For expelling the ingredients from the bottles serves a pressurized fluid such as nitrogen likewise contained therein or a pump. The correct mixing ratio of the three components is ensured by means of a control unit which calculates the opening of the pressure valves of the bottles in the correct ratio and controls the valves accordingly.

Accordingly, it is the objective of the invention to further develop a distance combat means of the generic type with simple means such that the effect with which the irritants, to which the body is exposed, act on the body, is improved.

This objective is achieved by means of the features of claim 1 and by means of the features of claim 2.

According to a first aspect of the invention, the distance combat means according to the invention is characterized in that the irritant is 2-chlorobenzylidene malonic acid dinitrile (CS), ω-chloroacetophenone (CN) or capsaicin (CPS), and the propellant is liquefied propellant gas such as, for example, propane or butane, with the distance combat means being configured as a spray unit, and the housing as a pressure container with spray nozzle, and wherein the housing moreover containing a solvent, such as, for example, acetone, butanone, nitromethane and dichloromethane in which the irritant and the medical adhesive are dissolved.

According to another aspect of the invention, the distance combat means according to the invention is characterized in that the irritant is 2-chlorobenzylidene malonic acid dinitrile (CS), ω-chloroacetophenone (CN) or capsaicin (CPS), with the distance combat means being configured as an irritant cartridge and the housing as a cartridge case closed by a plug which cartridge case contains the adhesive in liquid form, and with the housing accommodating a fully closed adhesive chamber containing the adhesive, which is formed in the plug closing the cartridge case, and wherein the plug being a cylindrical inner case pressed into the cartridge case with an internal and external transverse wall forming the adhesive chamber, and wherein the cylindrical inner case of the plug extending beyond the internal transverse wall towards the inside to the bottom of the cartridge case, wherein the support formed as a result on the side of the internal transverse wall facing the bottom being filled with the irritant.

Apart from the irritant contained in the housing of the distance weapon, at least a medical adhesive is contained in the housing. Medical adhesives exist in liquid form under normal conditions, hence room temperature and atmospheric pressure, and are actually intended for wound closure. These are cyanoacrylate preparations which are also used as an instant adhesive in a very similar way. However, preparations with high toxicity are not used as medical adhesives. Moreover, the term medical adhesives within the meaning of the present invention also includes compounds, which are used in so-called spray-on plasters to cover a wound, thus also have a certain adhesion on the endogenous tissue, although not such a strong adhesion as the above mentioned cyanoacrylate preparations. Said liquid plaster agents are, for example, made from polyvinylpyrrolidone or cellulose nitrate. The cyanoacrylate preparations added particularly advantageously as a medical adhesive are preferably butyl octyl or isobutyl cyanoacrylate esters. These are monomers which polymerize in contact with different body fluids, such as, for example, sweat, tears or blood or air humidity, and thus develop highly adhesive properties.

By adding such medical adhesives in addition to the irritant of the distance combat means, the exposure time of the irritant can be extended because the known irritants are very volatile on exposure to the body by spray or irritant gas cartridge so that the effect after application of the irritant by spraying or shooting is rapidly decreasing. Now, if medical adhesives of the type mentioned are added, the integrated irritants adhere on the attacker or animal to be warded off for a longer period of time which maximizes their effect. If one wants to achieve a particularly strong adhesive strength, cyanoacrylate preparations of the type mentioned are added, if one wants to achieve only a reduced type of adhesive strength, one takes the agents contained in the sprayon plaster, namely polyvinylpyrrolidone or cellulose nitrate.

According to the first aspect of the invention, the distance combat means is configured as a spray unit, wherein the housing of the distance combat means is of a spray can type, namely a pressure container with a spray nozzle, which spray can contain a liquefied propellant gas as a propellant, such as, for example, propane or butane. Furthermore, the spray can contains a solvent, such as, for example, acetone, butanone, nitromethane and dichloromethane in which the irritant is dissolved. Moreover, also the medical adhesive is dissolved in the solvent because cyanoacrylate preparations of the type mentioned are liquid in normal condition (at room temperature, atmospheric pressure) and like polyvinylpyrrolidone or cellulose nitrate can be dissolved in conventional solvents. The dissolved agent combination with the irritant and the medical adhesive is than distributed as an aerosol.

Instead of using a solvent for dissolving the irritant and the adhesive as well as a slightly reactive propellant gas as a propellant for expelling the solution, it would also be imaginable to use an easily liquefiable gas in the spray can or in the spray unit with corresponding solvent properties, such that the gas can act as a propellant gas and solvent at the same time.

Thus, for the distance combat means formed as a spray unit according to the first aspect of the invention, no special measures have to be taken in order to effect adding of the medical adhesive to the charge to be distributed.

In the case of the distance combat means formed as an irritant gas cartridge according to another aspect of the invention, however, the desired function is ensured by further advantageous measures.

According to said further aspect of the invention, the distance combat means is configured as an irritant gas cartridge and comprises a housing which is formed as a cartridge case closed by a plug. Here, the medical adhesive is contained in the irritant cartridge and/or in the housing in liquid form. Contained in liquid form means that the adhesive, when using the irritant cartridge under normal conditions (room temperature, atmospheric pressure), is liquid so that the medical adhesive is directly active, because cyanoacrylates exert their effect like polyvinylpyrrolidone or cellulose nitrate as an adhesive and/or glue only in liquid form with the irritant being accommodated in the irritant cartridge separately from the adhesive. In fact, irritant cartridges exist in which the irritant filling consists of an aqueous gel in which the irritant is dissolved so that it would also be imaginable to dissolve the medical adhesive in said aqueous gel at the same time. But it is questionable as to whether the desired sticking and/or adhesive effect is entirely maintained.

SUMMARY OF THE INVENTION

The irritants used according to the invention, however, are substances which, in normal condition, exist as a solid material and/or in powder form. Thus, 2-chlorobenzylidene malonic acid dinitrile is a colorless, crystalline compound with a melting point of 96° C., ω-chloroacetophenone a yellowish, crystalline solid material with a melting point of 56.5° C. and capsaicin a naturally occurring alkaloid with a melting point of 65 to 66° C. For an improved effect, it is therefore advantageous, if the irritant and the propellant are kept separately from each other in the cartridge case. This can also easily be carried out without any further measures due to the solid state. With respect to the liquid adhesive, however, the separation requires further measures.

For this purpose, a fully closed adhesive chamber containing the adhesive in liquid form is accommodated in the cartridge case and/or in the cartridge, namely in a plug closing the cartridge case, which plug can be preferably configured as a one-piece plastic part and which is pressed into the cartridge case, and thus could be filled with the liquid adhesive in the chamber in advance. The plug has the shape of a cylindrical inner case pressed into the cartridge case which comprises an internal and external transverse wall with the transverse walls and the area of the inner case between the transverse walls forming the adhesive chamber. Advantageously, the transverse walls each comprise at least one predetermined breaking point.

Moreover, the cylindrical inner case of the plug extends beyond the internal transverse wall towards the inside to the bottom of the cartridge case so that, as a result, on the side of the internal transverse wall facing the bottom, a support is formed which can be filled with the irritant. The support with the irritant can be likewise formed as a fully closed chamber by a bottom wall on the bottom of the plug with the bottom wall in that case preferably also comprising a predetermined breaking point and/or being made of plastic. On the other hand, the support can also be open and the separation of the irritant and the propellant can simply be made by storing them in different locations. It would also be imaginable to cover the support with the irritant by means of a lid or another separator element.

It is also advantageous, if the propellant is accommodated in the irritant cartridge separately from the adhesive, as the medical adhesive has to be separated from the solid material used in irritant cartridges as a propellant (gun powder, flash powder, cordite or cellulose nitrate), which propellant conventionally has to be conventionally located on the bottom of the irritant gas cartridge in order to expel the irritant-adhesive-charge after ignition.

Thus, advantageously, the cartridge case comprises a bottom into which an ignition cap is pressed or a rim close to the bottom into which a priming charge is poured, wherein the adhesive being located in an adhesive area away from the bottom, which is separated by an intermediate wall from an intermediate area in-between the bottom and the adhesive area, in which at least the propellant, preferably also the irritant is located.

Advantageously, at least two chambers are provided in the cartridge, the adhesive chamber and at least another chamber for receiving the propellant and the irritant in order to prevent absorbing of the adhesive by the propellants and/or irritants existing as a powder or as a solid material.

It is particularly preferred here, if the inside of the cartridge case is subdivided into three chambers, one for the adhesive, one for the propellant or the gunpowder and one for the irritant.

Furthermore, it is advantageous, if the adhesive is located close to the outlet opening of the cartridge on the side of the cartridge facing away from the bottom, and the propellant and irritant are located in the intermediate area between the adhesive and the bottom with the ignition cap or the priming charge, wherein the propellant still being located preferably on the side facing the bottom and the irritant still being located preferably on the side facing the adhesive and separately from each other. Thus, the intermediate area between the bottom and the adhesive area where the adhesive is accommodated close to the top is advantageously subdivided into a propellant area close to the bottom with the propellant and in contrast an irritant area more away from the bottom with the irritant. It is not absolutely necessary that a fixed separation of propellant and irritant exists. But advantageously, a separation of the intermediate area into propellant area and irritant area exists, for example, in the form of a lid located in-between, a membrane or a thin plastic wall.

Further, advantageously, the adhesive area is located on the side of the intermediate area facing away from the bottom directly below the covering wall of the plug closing the cartridge case. The covering wall of the plug can form simultaneously an external wall of the housing and a limiting wall of the adhesive area. In order to ensure discharge of the adhesive when shooting the cartridge, the covering wall of the plug is advantageously configured such that it bursts after launching the cartridge. For this purpose, it can, for example, be made from a plastic of such a thickness that this is ensured. Alternatively or in addition it may also comprise a predetermined breaking point.

Furthermore the adhesive area is advantageously separated from the intermediate area containing the propellant and the irritant by an intermediate wall limiting it on the side facing the bottom. In order to ensure here as well the bursting of the intermediate wall when shooting the cartridge and thus discharge of the adhesive but also expelling of the irritant, said intermediate wall may also be made of plastic. Moreover, alternatively or in addition, the intermediate wall comprises one (or several) predetermined breaking points causing or at least supporting the bursting of said wall when shooting the cartridge.

The intermediate wall and the covering wall can form part of the fully closed wall forming the adhesive chamber containing the adhesive which fully closed wall is configured advantageously integrally with the plug.

In the following, an advantageous embodiment of the invention is explained in detail by means of the attached figure.

DETAILED DESCRIPTION IN CONJUNCTION WITH THE DRAWINGS

Figure 1:
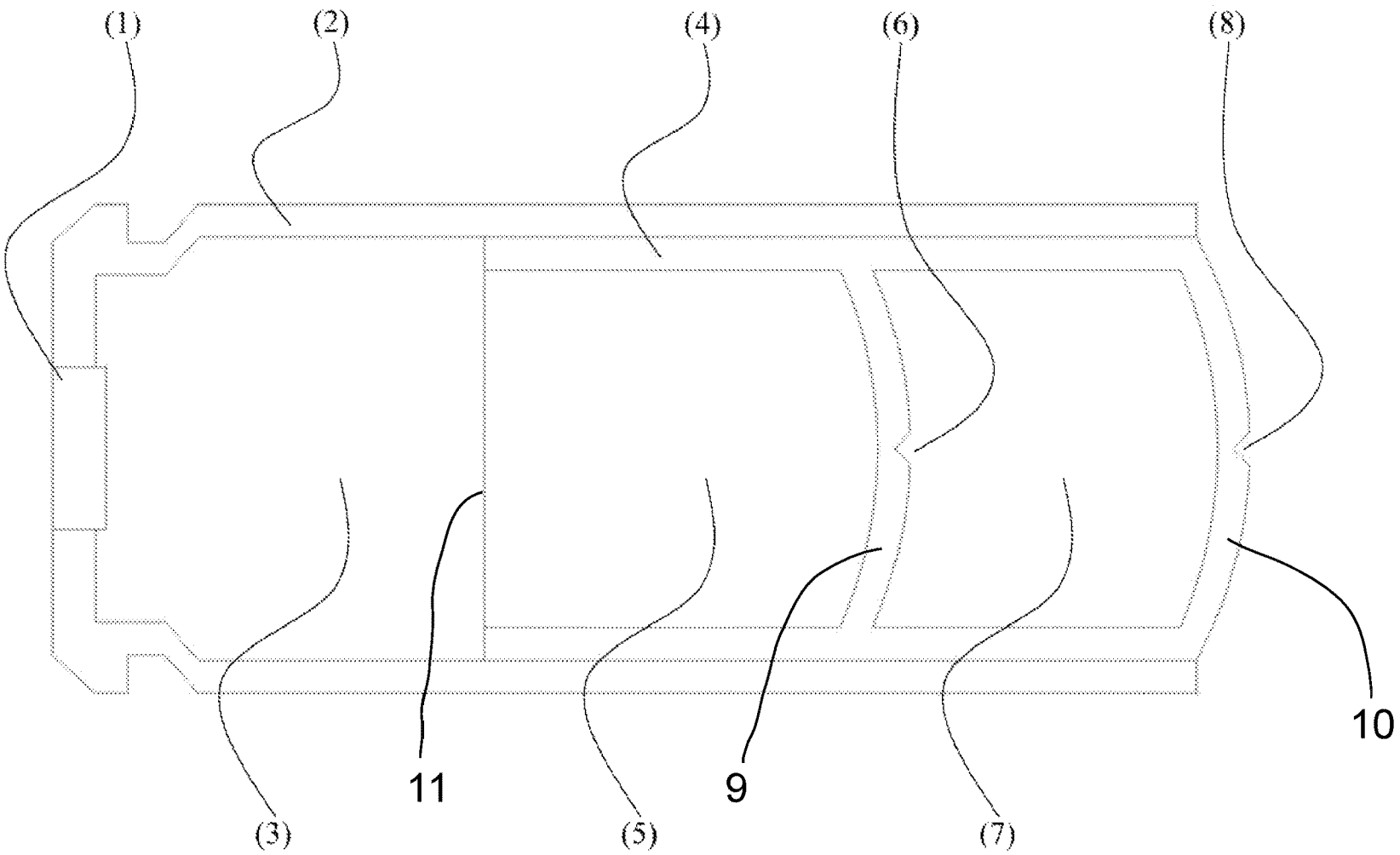
FIG. 1 shows a combat means configured as an irritant gas cartridge according to an advantageous embodiment of the invention in crosssection.

The irritant cartridge shown in FIG. 1 comprises a housing 2, 4 consisting of a cartridge case 2 and a plug 4. An ignition cap 1 is pressed into the bottom of the cartridge case 2. The ignition cap 1 can be configured as a Berdan ignition cap (Berdan ignition) or boxer ignition cap (boxer ignition). Alternatively the entire cartridge could be configured as a rimfire cartridge. In an area close to the bottom within the cartridge case 2 a propellant 3 is accommodated, for example, black powder.

The plug 4 consists of plastic material and is formed as a cylindrical inner case pressed into the cartridge case 2 having two transverse walls 9, 11. The external transverse wall 10 forms the external wall covering the cartridge on the side facing away from the bottom, and is provided with a predetermined breaking point 8. The internal transverse wall 9 is likewise provided with a predetermined breaking point 6. The two transverse walls 9, 10 and the section in-between of the inner cartridge form a closed adhesive chamber where a medical adhesive 7, for example, a cyanoacrylate preparation in liquid form is accommodated. On the side of the internal transverse wall 9 facing the bottom the cylindrical inner cartridge of the plug 4 extends further to the bottom in order to form another chamber in the plug 4, wherein an irritant 5, for example a solid material forming a CS gas made from 2-chlorobenzylidene malonic acid dinitrile is accommodated. Said further chamber is covered with a lid 11 on the bottom, for example, made from cardboard.

When the firing pin of the blank gun or revolver used impinges the ignition cap 1, said ignition cap ignites the propellant 3. As propellants 3, for example, also gunpowder, flash powder, cellulose nitrate or cordite can be used.

In the two-part chamber system of the plug 4 consisting of plastic, the irritant 5 is accommodated in the chamber close to the bottom. The medical liquid adhesive 7 is accommodated in the chamber away from the bottom.

By the enormous pressure, which occurs by the burnup of the propellant 3, the chamber system of the plug 4 bursts open on the predetermined breaking points 6 and 8 of the transverse walls 9, 10 and the medical liquid adhesive 7 as well as the irritant 5 are ejected from the cartridge case 2. The medical liquid adhesive 7 and the irritant 5 are then atomized in the barrel of the weapon used and together with combustion residues of the propellant 3 used escape the muzzle at high speed.

By body fluids on the affected body parts of the attacker or the animal to be warded off, polymerization of the cyanoacrylate 7 occurs. As a result, the irritant 5 adheres to the affected body parts affected for a longer period of time. When the eyes are directly affected, the irritant 5 cannot simply be washed out by tear fluid either because cyanoacrylate is not soluble in water. Hence, the attacker is out of action for a longer period of time than this would be the case with conventional irritant gas spray units and irritant gas cartridges.

Figure 2:
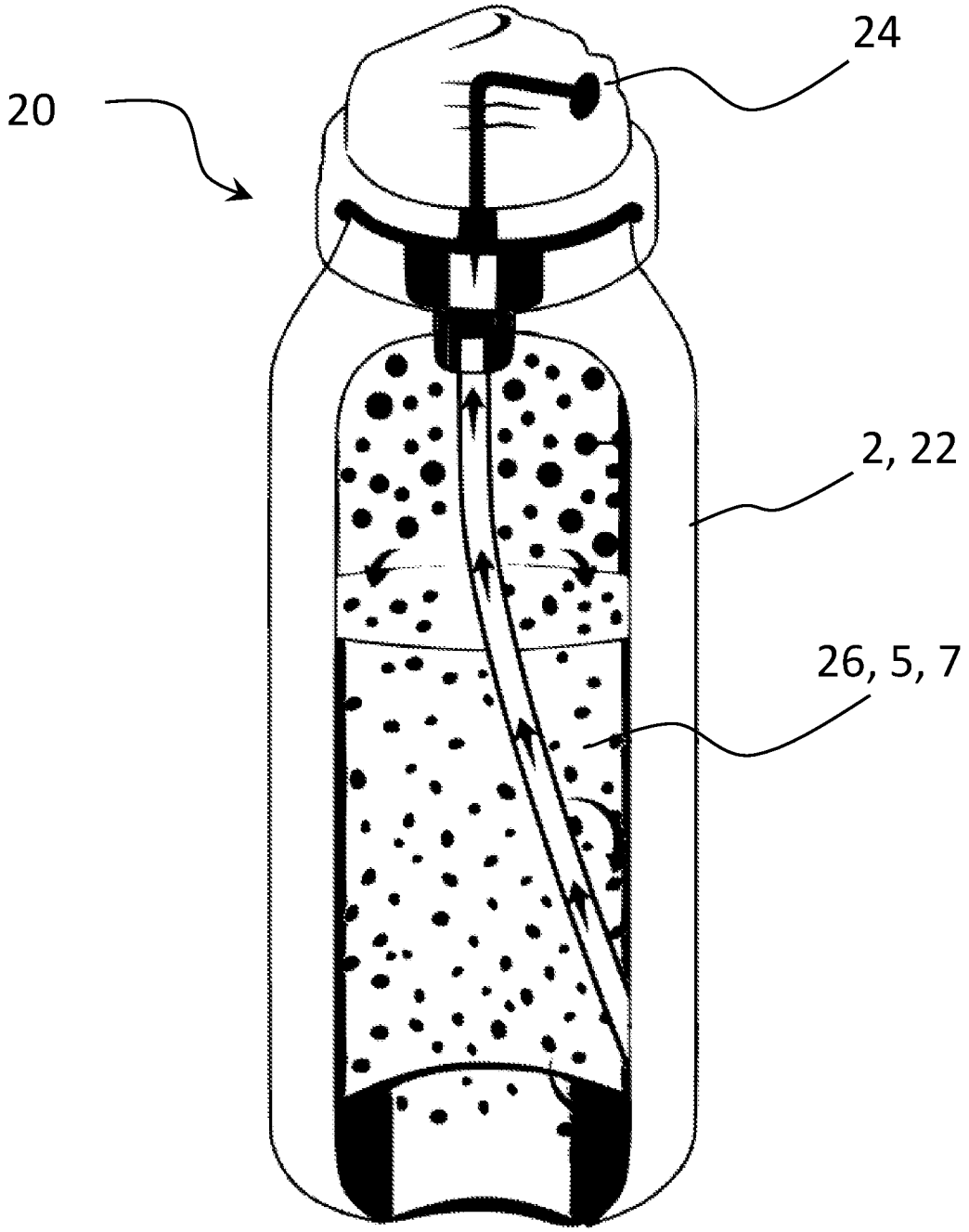
FIG. 2 shows a combat means configured as an irritant gas cartridge according to another embodiment of the invention.

In another embodiment, shown in FIG. 2, the distance combat means is configured as a spray unit 20, wherein the housing 2 of the distance combat means is of a spray can type, namely a pressure container 22 with a spray nozzle 24, which spray unit 20 can contain a liquefied propellant gas as a propellant, such as, for example, propane or butane. Furthermore, the spray unit 20 contains a solvent 26, such as, for example, acetone, butanone, nitromethane and dichloromethane in which the irritant 5 is dissolved. Moreover, also the medical adhesive 7 is dissolved in the solvent 26 because cyanoacrylate preparations of the type mentioned are liquid in normal condition (at room temperature, atmospheric pressure) and like polyvinylpyrrolidone or cellulose nitrate can be dissolved in conventional solvents. The dissolved agent combination with the irritant and the medical adhesive is then distributed as an aerosol.

Variations and modifications of the embodiment shown are possible without departing from the scope of the invention.

The invention claimed is:

1. A distance combat means for non-lethal exposure of the human or animal body to irritant, comprising a housing containing at least an irritant, a propellant and moreover at least one medical adhesive, wherein the irritant is 2-chlorobenzylidene malonic acid dinitrile (CS), ω-chloroacetophenone (CN) or capsaicin (CPS), and the propellant is liquefied propellant gas, wherein the distance combat means is configured as a spray unit and the housing as a pressure container with a spray nozzle, and wherein the housing moreover containing a solvent in which the irritant and the medical adhesive are dissolved.

2. The distance combat means according to claim 1, wherein the medical adhesive (7) is a cyanoacrylate preparation.

3. The distance combat means according to claim 1, wherein said medical adhesive is a cyanoacrylate preparation, polyvinylpyrrolidone or cellulose nitrate.

4. The distance combat means according to claim 1, wherein said solvent is acetone, butanone, nitromethane or dichloromethane.

5. A distance combat means for non-lethal exposure of the human or animal body to irritant, comprising a housing (2, 4) containing at least an irritant (5), a propellant (3) and moreover at least one medical adhesive (7), namely a cyanoacrylate preparation, polyvinylpyrrolidone or cellulose nitrate, wherein the irritant (5) is 2-chlorobenzylidene malonic acid dinitrile (CS), ω-chloroacetophenone (CN) or capsaicin (CPS), wherein the distance combat means is configured as an irritant cartridge and the housing (2, 4) as a cartridge case (2) closed by a plug (4) which cartridge case contains the adhesive (7) in liquid form, and wherein a fully closed adhesive chamber is accommodated in the housing (2,4) containing the adhesive (7) which adhesive chamber is configured in the plug (4) closing the cartridge case (2), and wherein the plug (4) is a cylindrical inner case pressed into the cartridge case with an internal and external transverse wall (9, 10) which form the adhesive chamber, and wherein the cylindrical inner case of the plug (4) extending beyond the internal transverse wall (9, 10) towards the inside to the bottom of the cartridge case (2), wherein the support formed as a result on the side of the internal transverse wall (9, 10) facing the bottom is filled with the irritant (5).

6. The distance combat means according to claim 5, wherein the propellant (3) is a solid material which exists in the cartridge case (2) in powder form and/or in solid form, and is accommodated in it separately from the adhesive (7).

7. The distance combat means according to claim 6, wherein the solid material is gun powder, flash powder, cellulose nitrate or cordite.

8. The distance combat means according to claim 5, wherein the irritant (3) exists in the cartridge case (2) in powder form and/or in solid form and is accommodated in it separately from the adhesive (7).

9. The distance combat means according to claim 5, wherein the cartridge case (2) comprises a bottom into which an ignition cap (1) is pressed, or a rim close to the bottom into which a priming charge is poured, wherein the adhesive (7) is located in an adhesive area away from the bottom which is separated from an intermediate area in-between the bottom and the adhesive area by the intermediate wall (9), in which intermediate area at least the propellant (3) is located.

10. The distance combat means according to claim 9, wherein the propellant (3) and the irritant (5) are located in the intermediate area and the adhesive area on the side of the intermediate area facing away from the bottom connects to the external transverse wall configured as a covering wall (10) of the plug (4) which transverse wall forms an external wall of the housing (2, 4) and is made of plastic and/or comprises a predetermined breaking point (8).

11. The distance combat means according to claim 10, wherein the intermediate area is subdivided into a propellant area close to the bottom with the propellant (3) and in contrast an irritant area more away from the bottom with the irritant (5).

12. The distance combat means according to claim 11, wherein the propellant area and the irritant area are separated by a lid located in-between.

13. The distance combat means according to claim 12, wherein the lid is made from felt or cardboard.

14. The distance combat means according to claim 9, wherein the inner transverse wall and/or intermediate wall (9) is made from plastic and/or comprises a predetermined breaking point (6).

15. The distance combat means according to claim 5, wherein the plug (4) in total is made in one piece and consists of plastic.

16. The distance combat means according claim 5, wherein the transverse walls (9, 10) each comprise at least one predetermined breaking point (6, 10).

17. The distance combat means according to claim 5, wherein the support, filled with the irritant (5) and formed on the side of the internal transverse wall (9, 10) facing the bottom, is closed.

18. The distance combat means according to claim 17, wherein the support filled with the irritant (5) is closed by a separator element.

19. The distance combat means according to claim 18, wherein separator element is a cardboard lid, put on the front side of the inner case facing the bottom.

20. The distance combat means according to claim 5, wherein the medical adhesive (7) is a cyanoacrylate preparation, namely a butyl, octyl or isobutyl cyanoacrylate ester.

* * * * *